US006338301B1

(12) United States Patent
Almond

(10) Patent No.: US 6,338,301 B1
(45) Date of Patent: Jan. 15, 2002

(54) FLUSH MOUNTED FLIP TOP TELECOMMUNICATION AND ELECTRICAL STATION FOR BOARD ROOM TABLES

(75) Inventor: Gordon S. Almond, Kelowna (CA)

(73) Assignee: Spider Manufacturing Inc., Kelowna (CA)

( * ) Notice: Subject to any disclaimer, the term of this patent is extended or adjusted under 35 U.S.C. 154(b) by 0 days.

(21) Appl. No.: 09/453,179

(22) Filed: Dec. 2, 1999

Related U.S. Application Data

(60) Provisional application No. 60/110,833, filed on Dec. 3, 1998.

(30) Foreign Application Priority Data

Feb. 26, 1999 (CA) ..... 2263062

(51) Int. Cl.[7] ..... A47B 37/00

(52) U.S. Cl. ..... 108/50.02; 108/26; 312/223.6; 174/48

(58) Field of Search ..... 108/25, 26, 50.01, 108/50.02; 312/223.6, 223.1, 223.3, 322; 174/48, 50, 57, 66; 220/3.8, 3.2, 241

(56) References Cited

U.S. PATENT DOCUMENTS 4,372,629 A * 2/1983 Propst et al. ..... 312/223.6
4,721,476 A * 1/1988 Zeliff et al. ..... 174/48 X
4,762,072 A * 8/1988 Boundy et al. ..... 108/50.02
4,792,881 A * 12/1988 Wilson et al. ..... 312/223.6 X
5,008,491 A * 4/1991 Bowman ..... 174/48
5,083,847 A * 1/1992 Peters ..... 312/322
5,230,552 A 7/1993 Schipper et al.
5,231,562 A * 7/1993 Pierce et al. ..... 108/50.02 X
5,351,173 A 9/1994 Byrne
5,399,010 A * 3/1995 McClung et al. ..... 312/322 X
5,709,156 A 1/1998 Gavaert et al.
5,860,713 A * 1/1999 Richardson ..... 312/223.6
D407,374 S 3/1999 Byrne
6,162,071 A * 12/2000 Muller ..... 174/48 X

* cited by examiner

*Primary Examiner*—Peter M. Cuomo
*Assistant Examiner*—Hanh V. Tran
(74) *Attorney, Agent, or Firm*—Anthony C. Edwards

(57) ABSTRACT

A telecommunication, data including audio and visual data, and electrical station which can be permanently mounted within an aperture formed in a board room table includes a container having a perimeter flange which supports the station within the table. The container also has separate compartments for electrical plug-ins and data and telecommunication jacks. The upper face of the compartments are tilted toward the user for ease of attaching plugs and jacks. A lid pivots between a closed position flush and coplanar with the table surface and an open position fully rotated below the surface of the table so as to permit unrestricted access by the user to the interior of the station.

36 Claims, 6 Drawing Sheets

64
60
64
52
50
46
56
52

32
26
58
38
3
3
40
42
41
40
41
26
58
4
24
24
4
62
10
24
34
66

64
60
64
46
50
52
38b
52
40
32'
38a
33b
42'
26
33a
34
58
10
28
24
20
24
16
18
22
58
26
62
28
66

FLUSH MOUNTED FLIP TOP TELECOMMUNICATION AND ELECTRICAL STATION FOR BOARD ROOM TABLES

CROSS REFERENCE TO RELATED APPLICATION

This application claims priority from U.S. Provisional Patent Application No. 60/110,833 filed Dec. 3, 1998 and Canadian Application No. 2,263,062 filed Feb. 26, 1999 titled Flush Mounted Flip Top Telecommunication And Electrical Station For Board Room Tables.

FIELD OF THE INVENTION

This invention relates to the field of electrical, data and telecommunication service boxes, and in particular service boxes which may be flush mounted within the surface of a board room table.

BACKGROUND OF THE INVENTION

With the need for rapid access to up-to-date information, business executives are utilising personal computers and telecommunication devices in boardrooms for access to and retrieval of information as well as for video conferencing. At the present time personal computers, cellular telephones or the like when brought into a board room for use during a meeting are usually battery powered since there is insufficient telecommunication or electrical connections in most boardrooms to accommodate individual connections for each person in attendance. If connections of this type are available they are usually limited in number and are of the conventional wall mounted type which require extension cords or computer cables of some length so as to typically interfere with passage around the boardroom table.

It is desirable, therefore, to have outlets for telecommunications, data and electricity accessible to each person seated around the board room table. Consequently, it is an object of the present invention to provide electrical, data and telecommunication service stations which are mounted through or under a hole in the table, and which are accessible through an opening in the station which is flush with the upper surface of the table.

SUMMARY OF THE INVENTION

The telecommunication, data and electrical station of the present invention includes a rigid container, mountable within an aperture formed through an upper, horizontal work surface of a table, such as a boardroom table. The container may be a rectangular box having surrounding an upper perimeter edge thereof, a container support such as a lip projecting outwardly therefrom. The upper surface of the lip may, in one embodiment, lie in a first plane parallel to an upper surface of the table when the container is mounted in the table through the aperture in the table. The lip may be a circumferential lip extending contiguously around the upper perimeter edge.

The container will typically include perimeter walls secured to and depending from the container support, for example in planes at right angles to the first plane, and a bottom wall connected to a lower edge of the perimeter walls spaced from the container support. The bottom wall has a conduit aperture therein to provide insertion access for data, including audio and video, electrical and telecommunication conduit. The container support and the perimeter walls defining an upper access aperture for access into the container. A service outlet support is mounted or mountable into the container for mounting thereon data, electrical and telecommunication service outlets in co-operation with the data, electrical and telecommunication conduit. The service outlet support has an upper mounting face recessed below the first plane when the service outlet support is mounted into the container.

Preferably, inside the telecommunication, data, and electrical station the upper mounting face lies in a plane which is canted with respect to the first plane so that the service outlets are generally in a line of sight through the upper access with a user sitting at the table when the station is mounted in the table. Insertion and removal of electrical plugs and telecommunication jacks is thereby facilitated.

In the preferred embodiment the telecommunication, data and electrical station further includes a selectively positionable lid which pivots between a closed position closing or covering the upper access aperture and an open position wherein the lid is pivoted completely into the container. In the closed position the lid lies within the upper access aperture flush and coplanar with the first container support. In the open position the lid allows unobstructed access through the upper access aperture to the upper mounting face when the service outlet support is mounted in the container.

In the structure of one preferred embodiment the service outlet support has depending therefrom support arms which are spaced inwardly from the perimeter walls, so that the perimeter walls and the support arms define a lid receiving cavity therebetween. The lid may then be pivoted about an axis of rotation, the axis of rotation generally parallel to the first plane, so that in the open position the lid is fully retracted into the lid receiving cavity so as to be stored below the first plane.

The upper mounting face may have an inwardly facing perimeter portion joined at the medial point thereof by a transverse strip thereby defining a pair of apertures under which conventional electrical and telecommunication service outlets are mounted. Depending from the transverse strip may be a divider wall dividing the container into separate electrical and telecommunication compartments.

Advantageously, securing means are provided to secure the station within the aperture formed in the table. In one embodiment the securing means are selectively positionable in vertical relation to the underside of the table and mountable on the perimeter walls. In particular, the securing means may be rigid flanges having threaded apertures for the threaded engagement therethrough of threaded bolts at right angles to the first plane so as to compress the table between an upper end of the bolt and the container support at right angles to the first plane.

The lid may in one embodiment have downwardly and outwardly projecting arms for pivotal connection generally at terminal ends of the arms to opposite walls of the perimeter walls. The lid may then be pivoted about its axis of rotation, which is advantageously parallel to and spaced from the first plane, so as to be rotatable between the open and closed positions. Again, in the open position the lid is fully rotated below the first plane into the container. Rotational stops may be mounted to an inside face of each of the opposite perimeter walls, positioned adjacent a rotation path of the lid, for contact with the lid when the lid is in the closed position.

BRIEF DESCRIPTION OF THE DRAWINGS

FIG. 8 is a sectional view along line 8—8 in FIG. 7.

DETAILED DESCRIPTION OF PREFERRED EMBODIMENTS

Figure 1:
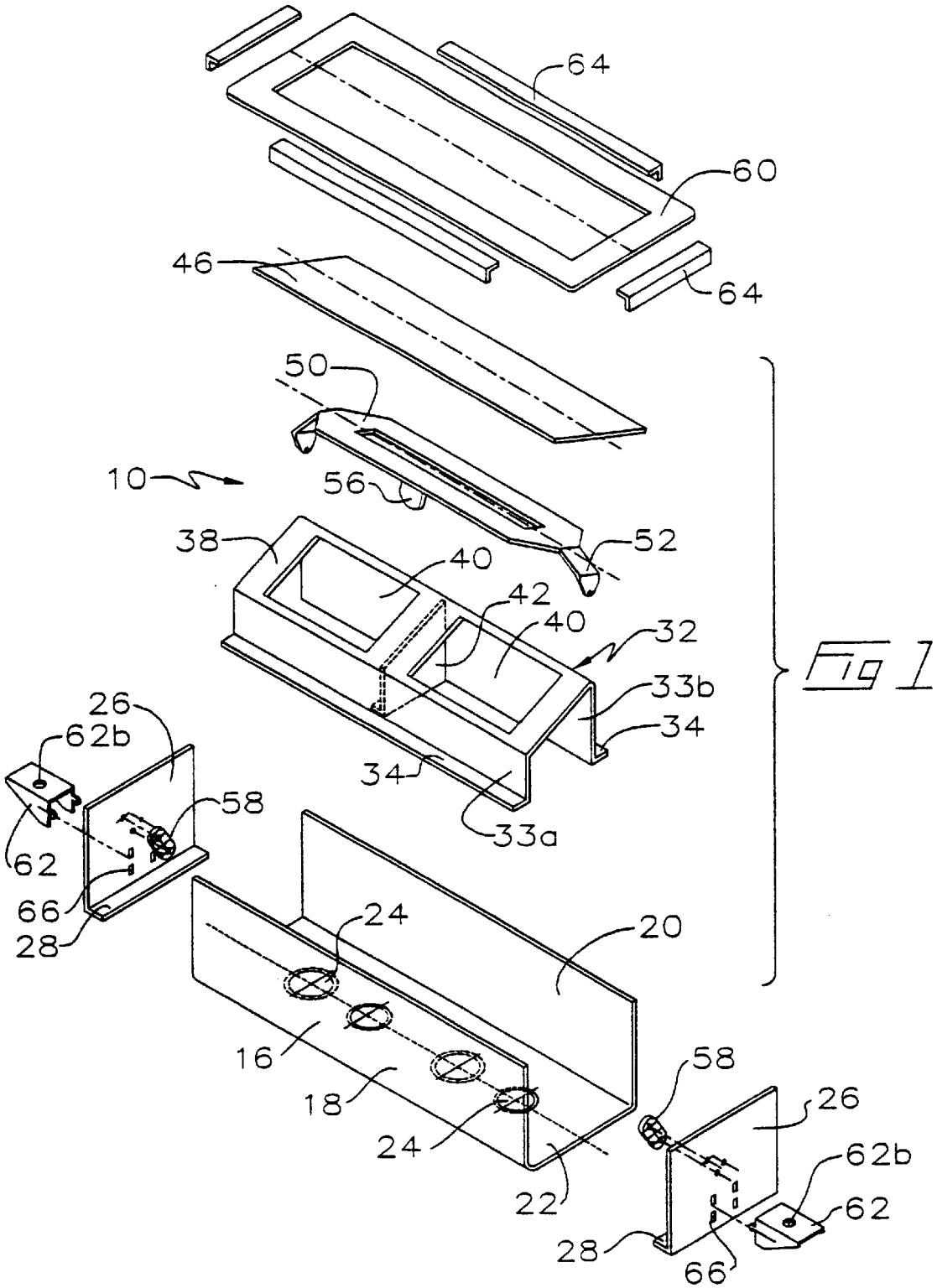
FIG. 1 is an exploded isometric view illustrating the components of the present invention.
Figure 2:
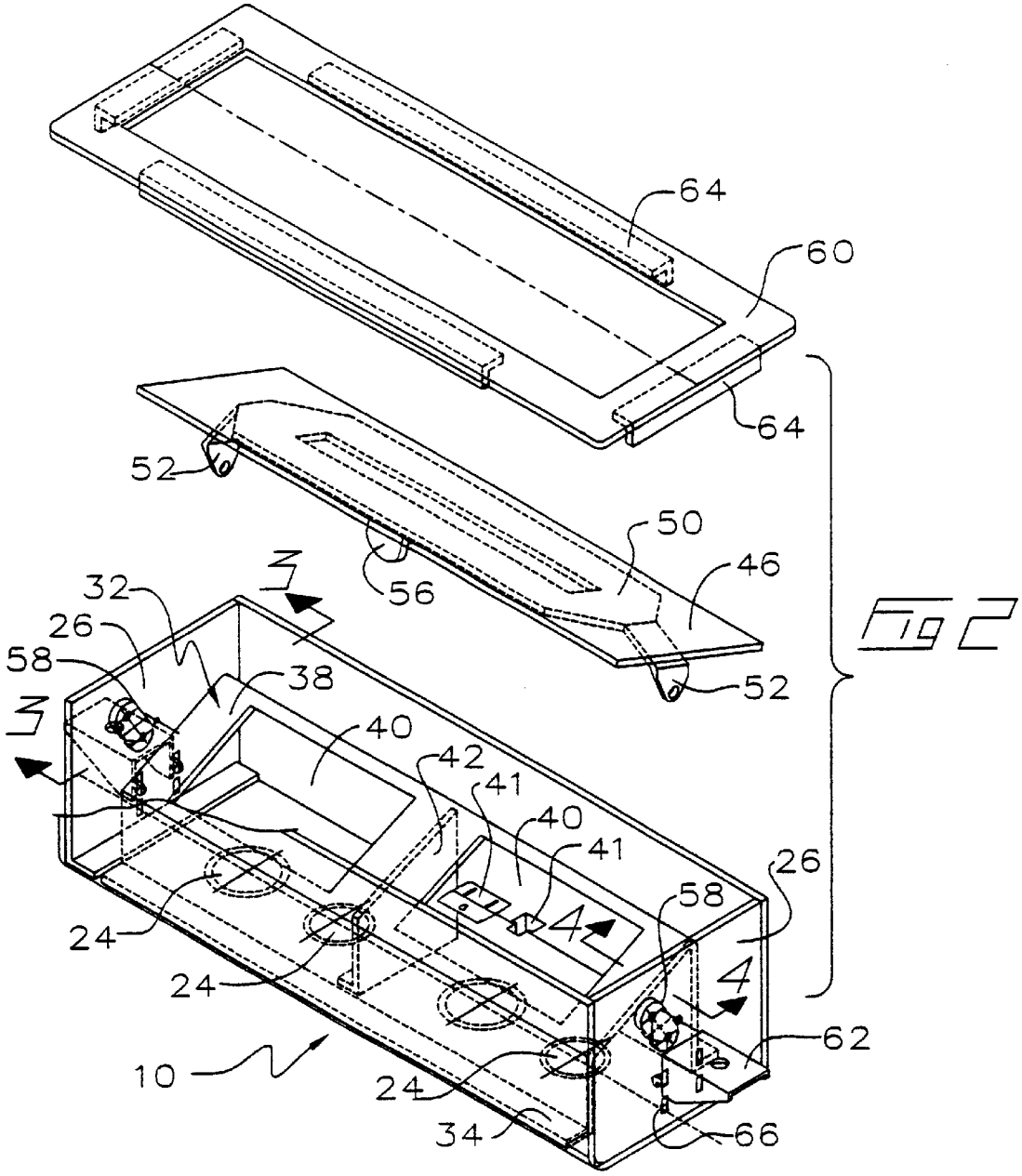
FIG. 2 is an exploded isometric view illustrating the present invention partially assembled.
Figure 3:
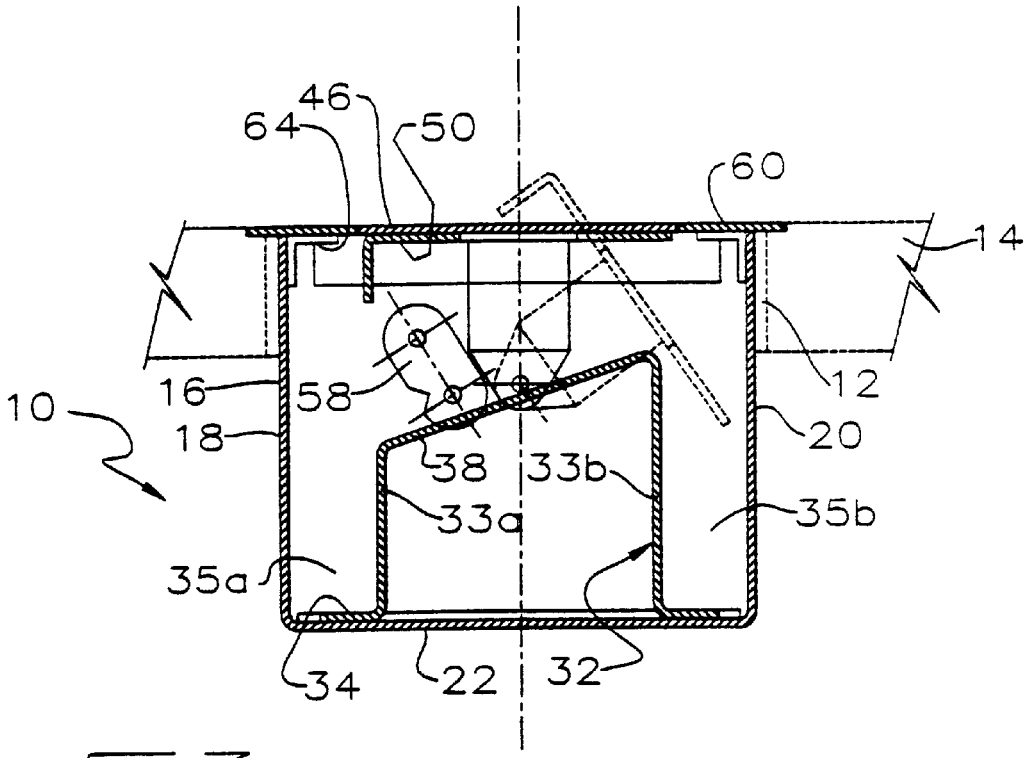
FIG. 3 is a sectional view along line 3—3 in FIG. 2.
Figure 4:
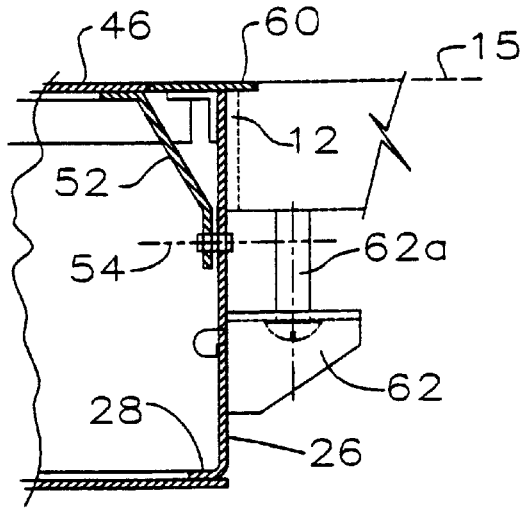
FIG. 4 is a sectional view along line 4—4 in FIG. 2.

Referring to FIGS. 1–4 , the telecommunication and electrical station of the present invention 10, is placed within an aperture 12 formed in, or cut through a board room tabletop 14, desk, or like work surfaces having a generally horizontal planar surface 15.

For ease of manufacture, the station may comprise a rigid rectangular housing 16, for example formed out of sheet metal, U-shaped in cross section and having integrally formed front, rear and bottom walls, referenced as 18, 20 and 22 respectively. Bottom wall 22 may advantageously contain holes or alternatively circular scored areas 24, of different diameters which can simply be knocked out to provide apertures or insertion points through which ends of electrical and communication, including audio and video, conduits may be inserted for connection to standard electrical and telecommunication receptacles of a type known in the art (not shown). A pair of opposed end walls 26, each having integrally formed inwardly facing flanges 28, are provided for separate attachment to the open ends of housing 16 to create a rigid enclosed container.

Electrical and telecommunication mounting means such as frame 32, for example having a generally inverted "U" shape in cross-section or other rigid supporting members for mounting into the container are provided to support the standard receptacles (for power supply and modem connection for example). Advantageously the mounting means cants the receptacles towards the users at an inclined angle for ease of access through aperture 12 when the user is sitting down at the edge of the table (the typical case). In the particular example of frame 32, integrally formed flanges 34, at the extremities of front and rear vertical legs 33*a* and 33*b* respectively, permit frame 32 to be securely fastened to the bottom portion of housing 16, such as by spot welding or the like. Flanges 34 space the vertical legs of mounting frame 32 from the front and rear walls of housing 16, so as to create fore and aft cavities 35*a* and 35*b* best seen in FIG. 8. Upper face 38 of mounting frame 32 is recessed below the upper edges of housing 16 and is canted in a direction which would be toward the user when station 10 is mounted into the table top. Upper face 38 contains a plurality of rectangular apertures 40 (illustrated as two, but not intended to be limiting), which electrical and telecommunication standard service outlets or receptacles 41 are mounted to the underside of. With the exception of FIG. 2, the standard receptacles are not illustrated for sake of clarity of illustration.

The inclined slope of the upper face of mounting frame 32 permits ease of connection and removal of conduits such as cords and cables from the service outlets 41 in a more horizontal, line of sight path for a user positioned at an acute angle relative to the table top such as would typically be the case with a user sitting facing the table top.

A solid divider 42 may be provided to divide mounting frame 32 into separate compartments for electrical and telecommunications. In one preferred embodiment, divider 42 is positioned intermediate between apertures 40 on the inside face of mounting frame 32. Divider 42 extends downward to contact bottom wall 22 and may be fastened thereto.

A lid faceplate 46, and a rectangular stiffener plate 50, are secured together such as by spot welding or the like. The rectangular stiffener plate has formed at each end thereof a downwardly projecting hinge arm 52. The pair of hinge arms are pivotally mounted at their extremities to end walls 26, so as to allow lid face plate 46 to pivot about a generally horizontal axis 54, where axis 54 is generally parallel to surface 15 of table 14. An operating tab 56 is provided on the stiffening plate intermediate arms 52 on the side of the plate which is exposed through aperture 12 when the lid is in its open position, that is, the position allowing access by the user to outlets 41.

The lid face plate 46 and the stiffener plate 50, which together form the lid, are rotated in a first rotational direction to align the lid flush and parallel to surface 15 of table 14 (the closed position) and are rotated in a second direction counter to the first direction to fully rotate the lid below the upper edges of container 16 (the open position). In the open position the lid is nested within cavities 35*a* and 35*b* defined between frame 32 and container 16, to allow unobstructed access to outlets 41. Rotation limiting plates 58, mounted on the inside face of each of the end walls 26, act as stops which are engaged by hinge arms 52 when the lid is rotated into its closed position to prevent over-rotation of the lid. The engagement of arms 52 with plates 58 at the point of closure ensures that lid faceplate 46 remains flush and coplanar with surface 15 of table 14.

An upper rectangular supporting flange 60 is secured to the upper perimeter edges of housing 16 by means of attaching angle members 64. Flange 60 forms a lip which extends around the upper circumference of station 10 and extends generally horizontally cantilevered outwardly therefrom. Supporting flange 60 and lid face 46 may be positioned flush with the upper surface 15 of the table top. Flange 60 may be fitted into a shallow recess or groove machined in upper surface 15 around the perimeter of aperture 12 for an absolutely flush mount. Housing 16 is thereby suspended in the table top with its upper surface flush with the table top surface so as to depend downwardly through aperture 12.

Figure 5:
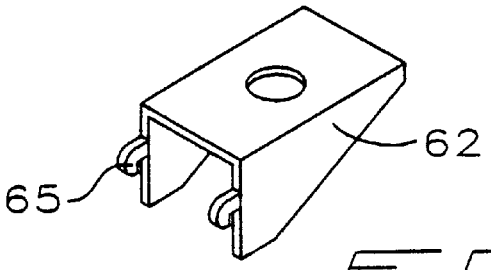
FIG. 5 is an isometric view illustrating a mounting clip.

Station 10 may be secured onto the table top by clamping the edges of the table top around the perimeter of aperture 12 between flange 60 and bolts 62*a* projecting upwardly from mounting clips 62. Projecting tabs 65 better seen in FIG. 5 are insertable into pairs of vertically aligned slots 66 formed through end walls 26. Threaded bolts 62*a* are journalled upwardly in threaded engagement through threaded holes 62*b* in the clips to engage the underside of table 14. As bolt 62*a* projects upwardly it presses against the underside of table top 14. Support flange 60 is thereby drawn down onto the upper surface 15 of table top 14 securing the flange flush and firmly against surface 15.

Figure 6:
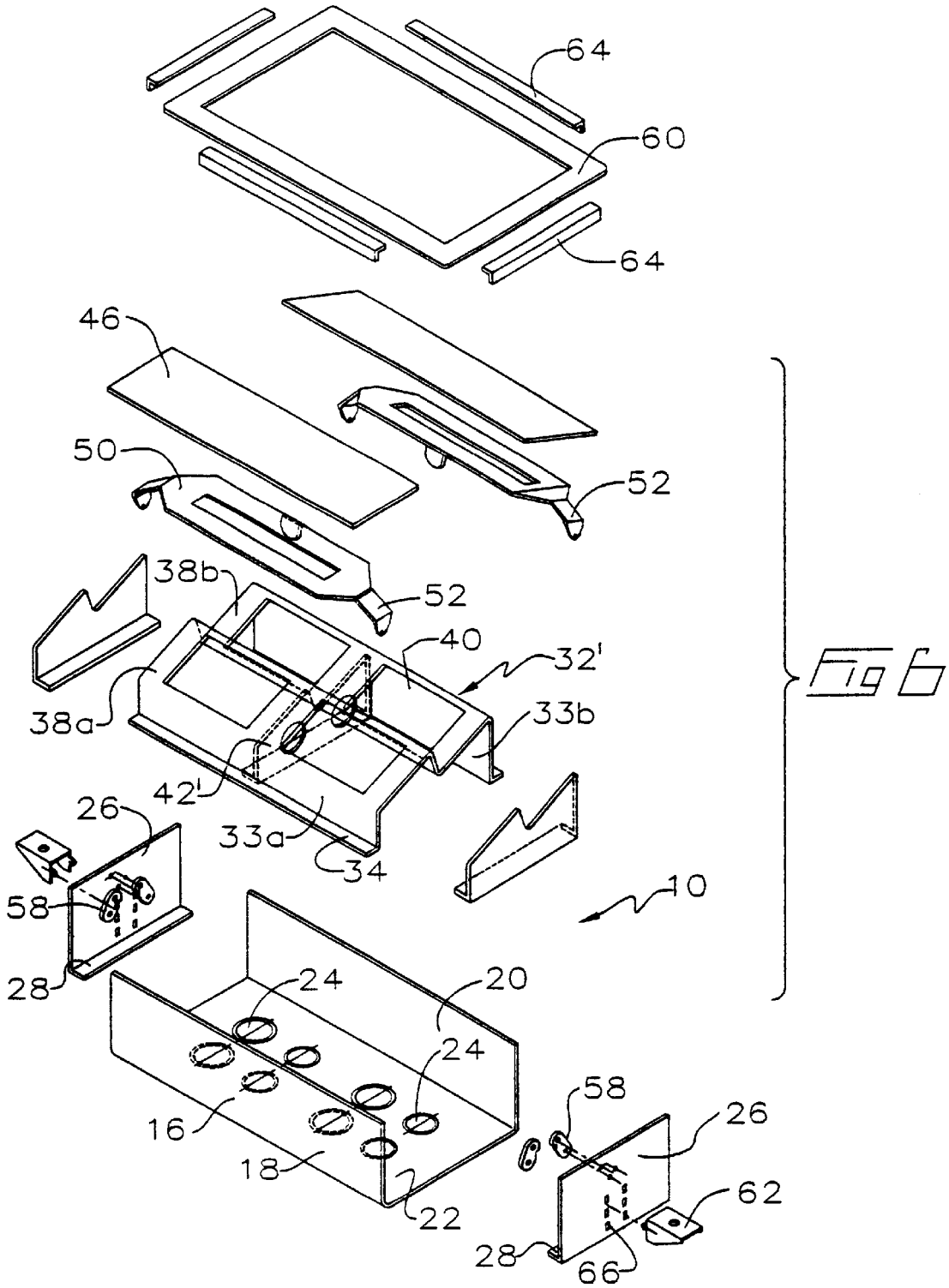
FIG. 6 is an exploded isometric view illustrating the device of FIG. 1, having a stepped mounting face.
Figure 7:
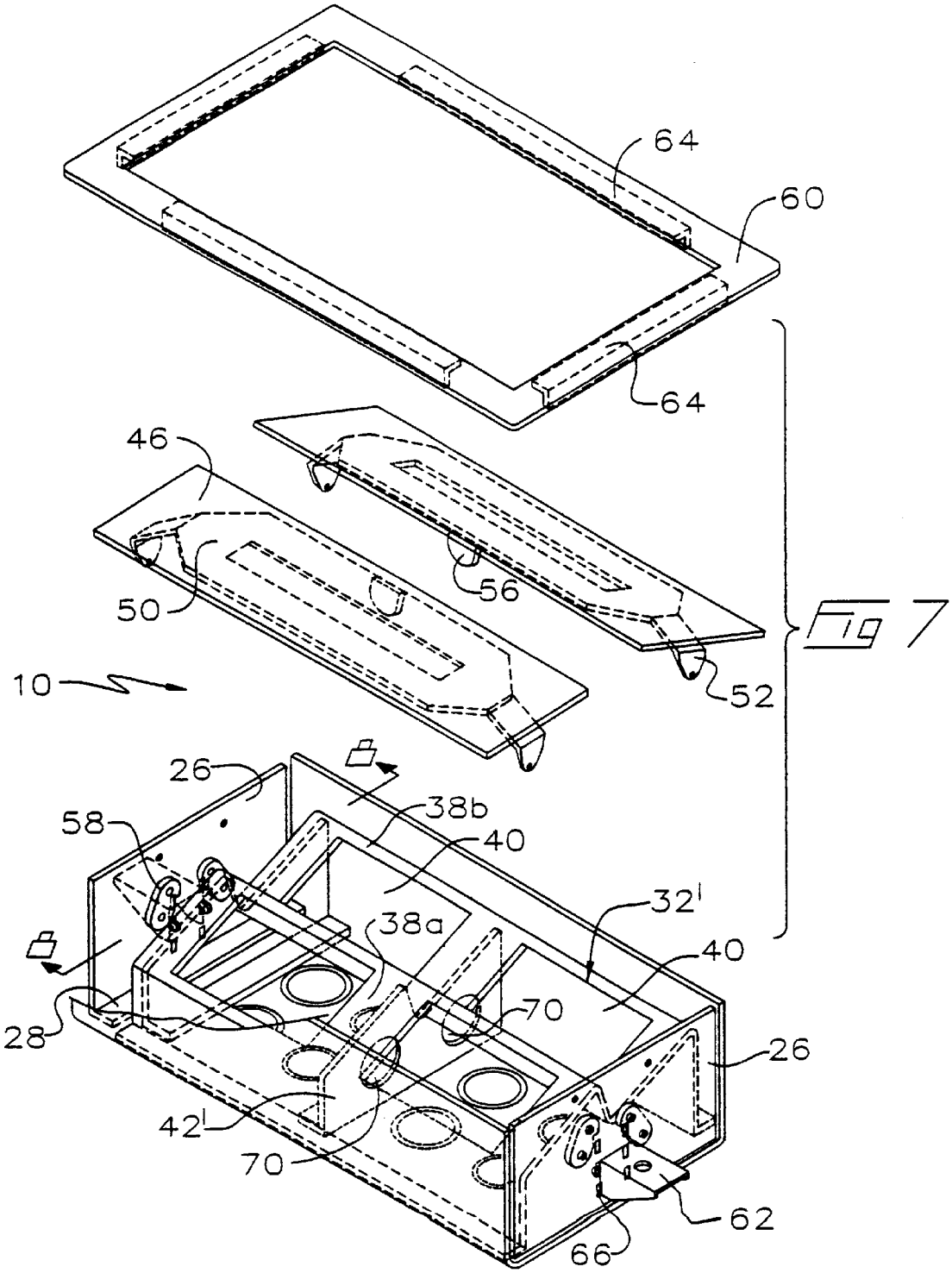
FIG. 7 is an exploded isometric view illustrating the device of FIG. 7 partially assembled.
Figure 6:
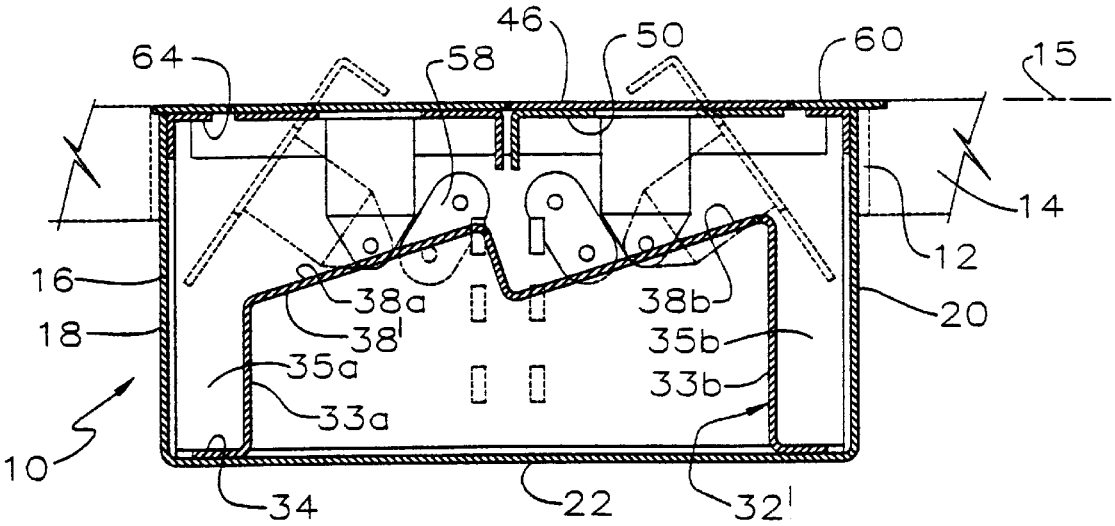

An alternative embodiment is illustrated in FIGS. 6–8. In this embodiment the single tier of service outlets 41 mountable to frame 32 are replaced with a double tier of service outlets mountable to a double tier supporting frame 32'. This allows for the mounting of a greater number of electrical, audio and visual data and telecommunication service outlets. Upper face 38' of mounting frame 32' is stepped along a longitudinally extending median bisecting housing 16 to create two tiered mounting faces 38*a* and 38*b*, in the same direction, each of which is canted preferably toward a user. Solid divider 42' is positioned intermediate the apertures and divides the mounting frame into separate compartments for electrical and telecommunications wiring. Divider 42' has apertures 70 which permit through passage of wiring. The lid may be split into a pair of clam-shell doors, each pivoting oppositely from the other between a flush closed position and an open position fully oppositely retracted into the housing and below the upper surface of the table.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A telecommunication, data, and electrical station which is flush mountable within an aperture formed through an upper work surface of a table the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support said bottom wall having a conduit aperture therein to provide insertion access for electrical avid telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, wherein said service outlet support has depending therefrom at least one generally vertical support arm which is spaced inwardly from one of said perimeter walls adjacent said at least one generally vertical support arm so as to elevate said upper mounting face from said bottom wall and so that said one of said perimeter walls and said at least one generally vertical support arm define a lid receiving cavity therebetween, and wherein said lid in said open position is generally entirely contained within said lid receiving cavity and generally entirely beneath said first plane.

2. A telecommunication, data and electrical station as claimed in claim 1 wherein said upper mounting face has an inwardly facing perimeter portion joined at the medial point thereof by a transverse strip thereby defining a pair of apertures under which conventional electrical, data and telecommunication service outlets are mounted, and wherein, depending from said transverse strip is a divider wall dividing said container into separate compartments.

3. The telecommunication, data and electrical station of claim 1 further comprising securing means to secure said station within said aperture formed in said table, said securing means selectively positionable in vertical relation to the underside of said table and mountable on said perimeter walls.

4. The telecommunication, data and electrical station of claim 3, wherein said securing means are rigid flanges having threaded apertures for the threaded engagement therethrough of threaded bolts at right angles to said first plane so as to compress said table between an upper end of said bolt and said container support at right angles to said first plane.

5. A telecommunication, data and electrical station as claimed in claim 1 wherein said upper mounting face lies in a plane which is canted with respect to said first plane and said service outlets are generally in a line of sight through said upper access aperture with a user sitting at said table when said station is mounted in said table whereby insertion and removal of electrical plugs, data and telecommunication jacks is facilitated by said canting of said upper mounting face.

6. A telecommunication, data and electrical station as claimed in claim 1 wherein said lid has downwardly and outwardly projecting arms for pivotal connection generally at terminal ends of said arms to opposite walls of said perimeter walls, said lid pivotable about an axis parallel to and spaced from said first plane, so as to be rotatable between said open and closed positions, and wherein in said open position said lid is fully rotated below said first plane into said container.

7. The telecommunication, data and electrical station of claim 1 wherein said lid is pivotable about an axis of rotation, said axis of rotation generally parallel to said first plane so that in said open position said lid is fully retracted into said lid receiving cavity below said first plane.

8. The telecommunication, data and electrical station of claim 1 further comprising rotational stops mounted to an inside face of each of said opposite perimeter walls, positioned adjacent a rotation path of said lid for contact with said lid when said lid is in said closed position.

9. A telecommunication, data and electrical station as claimed in claim 1 wherein said container support is a lip, cantilevered outwardly from said upper perimeter edge, and mountable flush and coplanar with said upper surface of said table.

10. The telecommunication, data and electrical station of claim 9 wherein said lip is a circumferential lip extending contiguously around said upper perimeter edge.

11. The telecommunication, data and electrical station of claim 1 wherein said lid is nested, when in said open position, within said lid receiving cavity.

12. The telecommunication, data and electrical station of claim 9 wherein said lip is sized to fit snugly within a groove formed around edges of said aperture in said table so as to mount an upper surface of said lip flush with said upper work surface of said table.

13. The telecommunication, data and electrical station of claim 11 wherein said lid is a pair of clam-shell doors, each of said clam-shell doors pivotable oppositely from the other between said closed position and said open position wherein said each of said clam-shell doors is nested within a corresponding said cavity between said perimeter walls of said container and said service outlet support when said service outlet support is mounted into said container.

14. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support said bottom wall having a conduit aperture therein to provide insertion access for electrical and telecommunication conduit, said container support and said perimeter walls defining an upper access aperture for access, into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face, wherein said service outlet support has depending therefrom at least one generally vertical support arm which is spaced inwardly from one of said perimeter walls adjacent said at least one generally vertical support arm so as to elevate said upper mounting face from said bottom wall and so that said one of said perimeter walls and said at least one generally vertical support arm define a lid receiving cavity therebetween, and wherein said lid in said open position is generally entirely contained within said lid receiving cavity and generally entirely beneath said first plane.

15. A telecommunication, data and electrical station as claimed in claim 14 wherein said upper mounting face has an inwardly facing perimeter portion joined at the medial point thereof by a transverse strip thereby defining a pair of apertures under which conventional electrical, data and telecommunication service outlets are mounted, and wherein, depending from said transverse strip is a divider wall dividing said container into separate compartments.

16. The telecommunication, data and electrical station of claim 14 further comprising securing means to secure said station within said aperture formed in said table, said securing means selectively positionable in vertical relation to the underside of said table and mountable on said perimeter walls.

17. The telecommunication, data and electrical station of claim 16 wherein said securing means are rigid flanges having threaded apertures for the threaded engagement therethrough of threaded bolts at right angles to said first plane so as to compress said table between an upper end of said bolt and said container support at right angles to said first plane.

18. A telecommunication, data and electrical station as claimed in claim 14 wherein said upper mounting face lies in a plane which is canted with respect to said first plane and said service outlets are generally in a line of sight through said upper access aperture with a user sitting at said table when said station is mounted in said table whereby insertion and removal of electrical plugs, data and telecommunication jacks is facilitated by said canting of said upper mounting face.

19. A telecommunication, data and electrical station as claimed in claim 14 wherein said lid has downwardly and outwardly projecting arms for pivotal connection generally at terminal ends of said arms to opposite walls of said perimeter walls, said lid pivotable about an axis parallel to and spaced from said first plane, so as to be rotatable between said open and closed positions, and wherein in said open position said lid is fully rotated below said first plane into said container.

20. The telecommunication, data and electrical station of claim 15 wherein said lid is, pivotable about an axis of rotation, said axis of rotation generally parallel to said first plane so that in said open position said lid is fully retracted into said lid receiving cavity below said first plane.

21. The telecommunication, data and electrical station of claim 14 further comprising rotational stops mounted to an inside face of each of said opposite perimeter walls, positioned adjacent a rotation path of said lid for contact with said lid when said lid is in said closed position.

22. A telecommunication, data and electrical station as claimed in claim 14 wherein said container support is a lip, cantilevered outwardly from said upper perimeter edge, and mountable flush and coplanar with said upper surface of said table.

23. The telecommunication, data and electrical station of claim 22 wherein said lip is a circumferential lip extending contiguously around said upper perimeter edge.

24. The telecommunication, data and electrical station of claim 14 wherein said lid is nested, when in said open position, within said lid receiving cavity.

25. The telecommunication, data and electrical station of claim 22, wherein said lip is sized to fit snugly within a groove formed around edges of said aperture in said table so as to mount an upper surface of said lip flush with said upper work surface of said table.

26. The telecommunication, data and electrical station of claim 24 wherein said lid is a pair of clam-shell doors, each of said clam-shell doors pivotable oppositely from the other between said closed position and said open position wherein said each of said clam-shell doors is nested within a corresponding said cavity between said perimeter walls of said container and said service outlet support when said service outlet support is mounted into said container.

27. A telcommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical and telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, wherein said upper mounting face has an inwardly facing perimeter portion joined at the medial point thereof by a transverse strip thereby defining a pair of apertures under which conventional electrical, data and telecommunication service outlets are mounted, and wherein, depending from said transverse strip is a divider wall dividing said container into separate compartments.

28. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical and telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, further comprising securing means to secure said station within said aperture formed in said table, said securing means selectively positionable in vertical relation to the underside of said table and mountable on said perimeter walls, and wherein said securing means are rigid flanges having threaded apertures for the threaded engagement therethrough of threaded bolts at right angles to said first plane so as to compress said table between an upper end of said bolt and said container support at right angles to said first plane.

29. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support said bottom wall having a conduit aperture therein to provide insertion access for electrical and telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, wherein said lid has downwardly and outwardly projecting arms for pivotal connection generally it terminal ends of said arms to opposite walls of said perimeter walls, said lid pivotable about an axis parallel to and spaced from said first plane, so as to be rotatable between said open and closed positions, and wherein in said open position said lid is fully rotated below said first plane into said container.

30. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said tables, perimeter walls secured to and depending from said container support and a bottom wall connected to a lower edge of said perimeter walls spaced from said container support said bottom wall having a conduit aperture therein to provide insertion access for electrical and telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, further comprising rotational stops mounted to an inside face of each of said opposite perimeter walls, positioned adjacent a rotation path of said lid for contact with said lid when said lid is in said closed position.

31. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter wills secured to and depending from said container support and a bottom wall connected to a lower edge of said perimeter walls spaced from said container support said bottom wall having a conduit aperture therein to provide insertion access for electrical and telecommunication conduit, said container support and said perimeter walls defining an upper access aperture for access into said container, a service outlet support mountable into said container for mounting thereon electrical and telecommunication service outlets in cooperation with said electrical and telecommunication conduit, said service outlet support having an upper mounting face recessed below said first plane when said service outlet support is in mounted into said container, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face when said service outlet support is mounted in said container, and wherein said lid is nested, when in said open position, within a cavity formed between said perimeter walls of said container and said service outlet support when said service outlet support is mounted into said container, and wherein said lid is a pair of clam-shell doors, each of said clam-shell doors pivotable oppositely from the other between said closed position and said open position wherein said each of said claim-shell doors is nested within a corresponding said cavity between said perimeter walls of said container and said service outlet support when said service outlet support is mounted into said container.

32. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical telecommunication conduit, said container support and said perimeter walls defining an upper access aperture for access into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face, wherein said upper mounting face has an inwardly facing perimeter portion joined at the medial point thereof by a transverse strip thereby defining a pair of apertures under which conventional electrical, data and telecommunication service outlets are mounted, and wherein, depending from said transverse strip is a divider wall dividing said container into seperate compartments.

33. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical and telecommunication conduit, said container support and said perimeter walls defining an upper access aperture for access into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face, further comprising securing means to secure said station within said aperture formed in said table, said securing means selectively positionable in vertical relation to the underside of said table and mountable on said perimeter walls, wherein said securing means are rigid flanges having threaded apertures for the threaded engagement therethrough of threaded bolts at right angles to said first plane so as to compress said table between an upper end of said bolt and said container support at right angles to said first plane.

34. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical and telecommunication conduit, said container support and said perimeter walls defining an upper access aperture for access into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face, wherein said lid has downwardly and outwardly projecting arms for pivotal connection generally at terminal ends of said arms to opposite walls of said perimeter walls, said lid pivotable about an axis parallel to and spaced from said first plane, so as to be rotatable between said open and closed positions, and wherein in said open position said lid is fully rotated below said first plane into said container.

35. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical and telecommunication conduit, said container support and said perimeter walls defining an upper access aperture for access into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an open position wherein said lid is pivoted completely into said container, said lid when pivoted into said closed position lying flush and coplanar with said container support within said upper access aperture, and when pivoted into said open position providing access through said upper access aperture to said upper mounting face, further comprising rotational stops mounted to an inside face of each of said opposite perimeter walls, positioned adjacent a rotation path of said lid for contact with said lid when said lid is in said closed position.

36. A telecommunication, data, and electrical station which is flush mountable within an aperture formed through an upper work surface of a table, the station comprising:

a rigid container wherein said container has surrounding an upper perimeter edge thereof, a container support projecting outwardly therefrom in a first plane parallel to an upper surface of said table when said container is mounted in said table through said aperture in said table, perimeter walls secured to and depending from said container support and a bottom wall connected to a lower edge of said perimeter walls spaced from said container support, said bottom wall having a conduit aperture therein to provide insertion access for electrical arid telecommunication conduit, said container support and said perimeter walls defining an upper access aperture for access into said container, a service outlet support mounted into said container for mounting thereon electrical and telecommunication service outlets in cooperation with said electrical and telecommunication conduit, said service outlet support having an upper mounting face recessed below said first plane, a lid selectively pivotable between a closed position covering said upper access aperture and an opens position wherein said lid is pivoted completely into said container, said lid when pivoted into said closed position lying flush and coplanar with said container support within said upper access aperture, and when pivoted into said open position providing access through said upper access aperture to said upper mounting face, wherein said lid is nested, when in said open position, within a cavity formed between said perimeter walls of said container and said service outlet support when said service outlet support is mounted into said container, wherein said lid is a pair of clam-shell doors, each of said clam-shell doors pivotable oppositely from the other between said closed position and said open position wherein said each of said clam-shell doors is nested within a corresponding said cavity between said perimeter walls of said container and said service outlet support when said service outlet support is mounted into said container.

* * * * *